US007757851B2

(12) United States Patent
Schnaars

(10) Patent No.: US 7,757,851 B2
(45) **Date of Patent: *Jul. 20, 2010**

(54) POT BELLY BAG

(76) Inventor: Daniel R. Schnaars, 153 S. Long St., Lafayette, LA (US) 70506

( * ) Notice: Subject to any disclaimer, the term of this patent is extended or adjusted under 35 U.S.C. 154(b) by 692 days.

This patent is subject to a terminal disclaimer.

(21) Appl. No.: 11/559,717

(22) Filed: Nov. 14, 2006

(65) Prior Publication Data

US 2007/0119857 A1 May 31, 2007

Related U.S. Application Data

(60) Provisional application No. 60/737,257, filed on Nov. 15, 2005.

(51) Int. Cl.
*B65D 19/00* (2006.01)
*B65D 33/02* (2006.01)

(52) U.S. Cl. ..... 206/386; 206/599; 206/600; 383/119

(58) Field of Classification Search ..... 206/386, 206/595–600; 108/51.11, 55.1, 56.3; 383/119, 383/121–121.1, 24
See application file for complete search history.

(56) References Cited

U.S. PATENT DOCUMENTS

| | | | | |
|---|---|---|---|---|
| 2,698,696 | A | 1/1955 | Strong | |
| 4,364,424 | A | 12/1982 | Nattrass | |
| RE32,308 | E | 12/1986 | Nattrass | |
| 4,830,191 | A | 5/1989 | Dijksman | |
| 5,465,865 | A | 11/1995 | Coombes | |
| 5,507,237 | A | 4/1996 | Barrow et al. | |
| 5,613,447 | A | 3/1997 | Trickett | |
| 5,785,175 | A | 7/1998 | Cholsaipant | |
| 6,213,305 | B1 | 4/2001 | Baker et al. | |
| 6,390,675 | B1 | 5/2002 | Jardine | |
| 6,467,625 | B2 | 10/2002 | Baker et al. | |
| D492,835 | S * | 7/2004 | Michaels et al. | D34/38 |
| 6,926,144 | B1 | 8/2005 | Schnaars, Jr. et al. | |
| 6,935,500 | B1 | 8/2005 | Schnaars | |
| 7,207,443 | B2 | 4/2007 | Von Merveldt | |
| 2005/0092638 | A1 * | 5/2005 | Michaels et al. | 206/386 |

* cited by examiner

*Primary Examiner*—Bryon P Gehman
(74) *Attorney, Agent, or Firm*—Garvey, Smith, Nehrbass & North, L.L.C.; Gregory C. Smith

(57) ABSTRACT

A pot belly bag which includes a bag portion having four walls and a top portion, and a floor portion; a portion extending outwardly and downwardly from the floor portion, which defines the pot belly portion; a pair of channels formed along either sidewall of the pot belly portion with the channel sleeves secured along the underside of the pot belly portion of the bag which results in the two sleeves and the pot belly functioning as a united unit to overcome various stresses normally placed upon the bag. The bag also provides a free flowing product which may attempt to push the sidewalls of the pot belly outward contacts the plastic channels in an attempt to outwardly displace the channel, but as the channel begins to move outwardly it immediately encounters the outer sleeve which is tied to the pot belly which restricts outer movement and spreads the forces out along its entire length.

15 Claims, 7 Drawing Sheets

POT BELLY BAG

CROSS-REFERENCE TO RELATED APPLICATIONS

Priority of U.S. Provisional Patent Application Ser. No. 60/737,257, filed Nov. 15, 2005, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to fabric bulk bags and more particularly into an improvement in a bulk bag having a floor portion which includes a pair of spaced apart pockets for receiving a rigid member to define a channel through which tines of a forklift may enter.

2. General Background and Description of the Invention

FIG. 1 in this application illustrates one of the bags made from a prior art design. This bag that applicant became aware of was constructed which concentrated on a plastic channel design and how to hold that channel into place. The bag design that applicant witnessed showed good promise in this direction but needed several design changes to eliminate weak points and allow for consistent bag manufacturing. Further, the bag design witnessed by applicant called for puncturing the bag in order to anchor the channel. Applicant believed this caused product leakage and was unacceptable to most in the commercial market. Applicant began concentrating on a bag design that would hold the channels in the correct place and restrict the bottom of the bag from sagging downward.

BRIEF SUMMARY OF THE INVENTION

The improvement of the present invention relates to the redefining the shape of the sleeves and the attachment between the sleeves and the pot belly portion into which the rigid channels are placed so that while making it easier to insert the channels into the sleeves, the pot belly portion, when filled with product is less likely to become misshaped and provide a more flat, stable base to the bag.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Additionally, applicant is aware of the Liftsystems patent that requires an elastic material to hold the tubes in place as well as several design channels which address the pressure that the channel must withstand. The basic form of the bag design that was witnessed by applicant will not require elastic to hold the channels in place. However, the tube described in that bag fails to take into account the tremendous pressures that are applied against them whenever the bag is suspended by its loops. The Liftsystems patent, on the other hand, described a much more robust channel.

Figure 1:
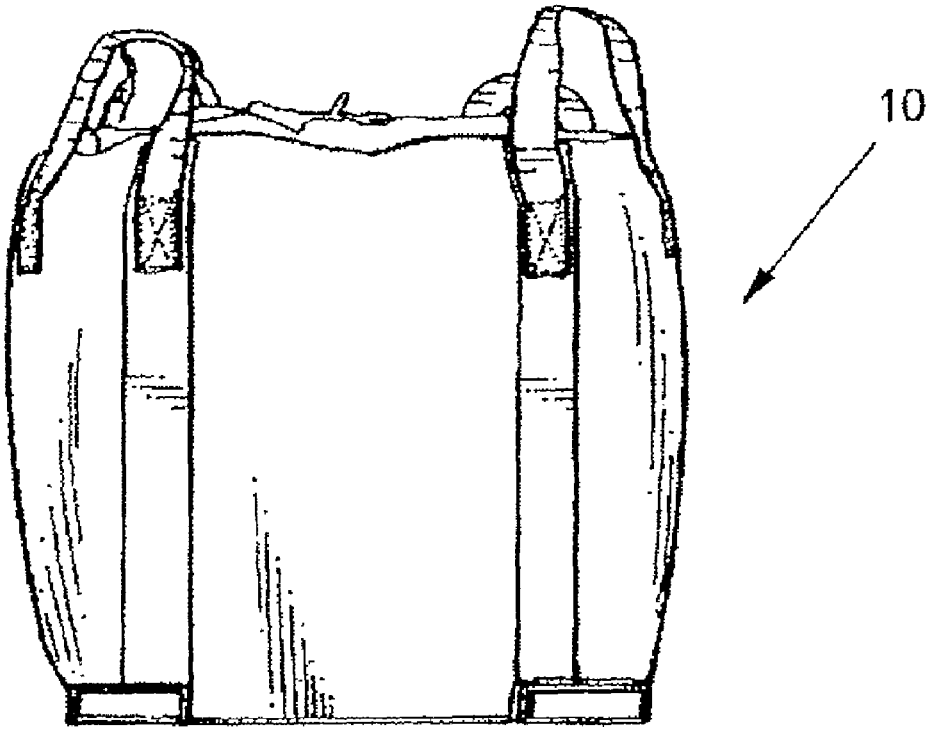
FIG. 1 illustrates an overall view of a bag design in the present invention.
Figure 2:
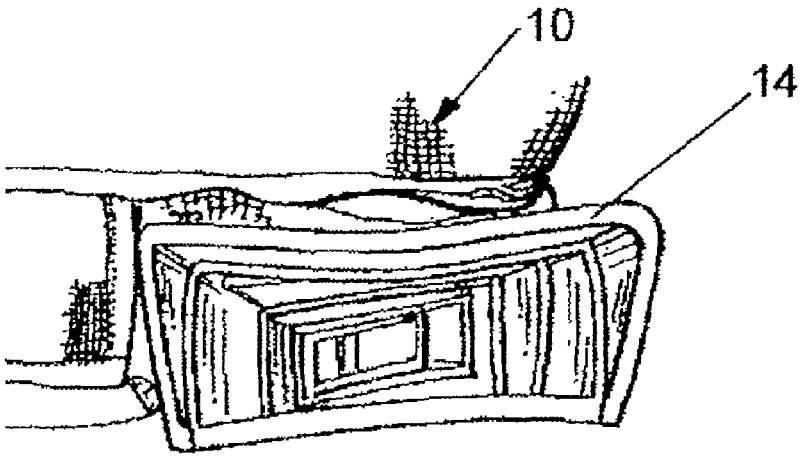
FIG. 2 illustrates a partial view of the bag design illustrated in FIG. 1.
Figure 3:
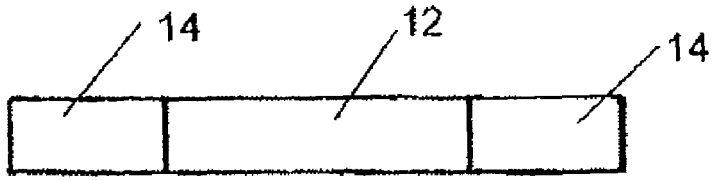
FIG. 3 illustrates an isolated view of a channel utilized in the bag of the present invention.
Figure 4:
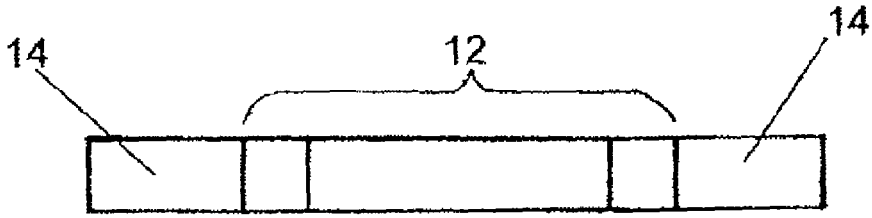
FIG. 4 illustrates a depiction of the pot belly portion of the bag and channels of the present invention.
Figure 5:
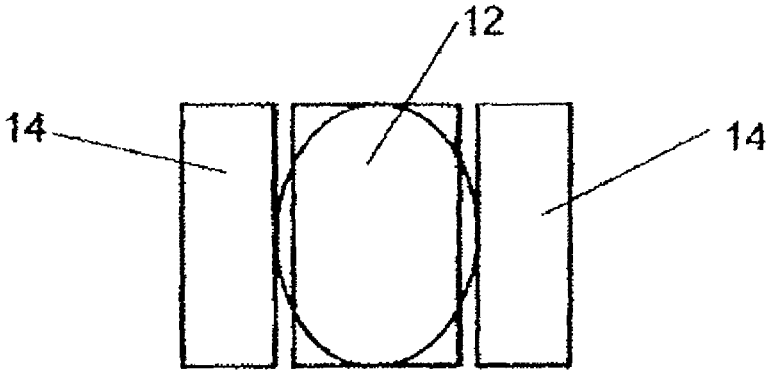
FIG. 5 illustrates a depiction of the pot belly portion and channels of the present invention as displaced when filled with material.
Figure 6:
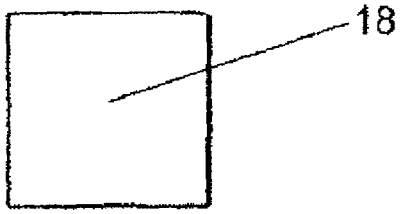
FIG. 6 illustrates a top view of the displacement of the bag when filled in the present invention.

As illustrated in FIG. 2, there is illustrated a bag suspended by loops. As illustrated in FIG. 3, there is a close-up of one of the channels showing the bag pressure deforming the channel. Applicant has found that free flowing product will always try to form a natural cylinder inside of any constraint. This is the issue that must be overcome in the new and improved bag which applicant calls his pot belly bag. Even though the shape between the channels is rectangular when made, the natural forces of the free flowing product will try to reshape the rectangle into a circle. This pressure disposes the channel outward from the intended position. As seen in FIG. 4, there is a front view of the pot belly bag and the channels while the bag is unfilled. As seen in FIG. 5, after filling, the pot belly portion rounds out and displaces the channel as seen by the arrows. FIG. 6 illustrates a top view of this displacement illustrated in side view in FIG. 5 which shows the original shape of the tray, the rectangular portion, and the displacement which has occurred in the blue oval in FIG. 6.

Figure 7:
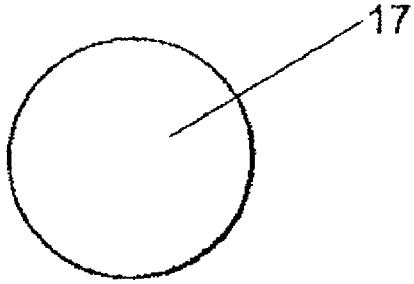
FIG. 7 illustrates a top view of an unfilled bulk bag.
Figure 8:
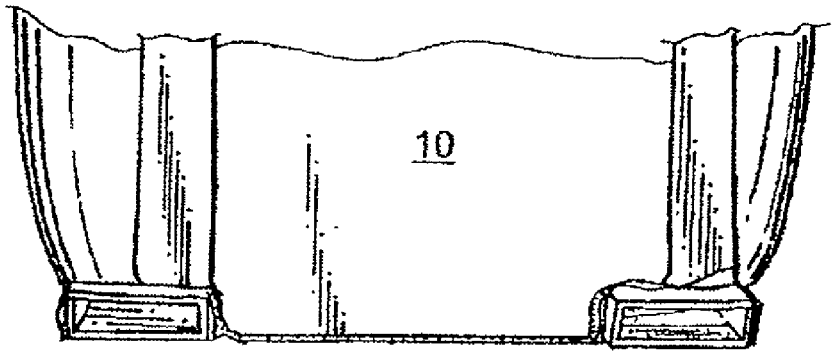
FIG. 8 illustrates a top view of a filled bulk bag.

It should be noted that a standard bulk bag starts out as a 36"×36" bag made in a square configuration as shown in FIG. 7. However, the flexible fabric transforms from a square to a circle that is approximately 45" in diameter as a result of the natural forces of gravity and free flowing product as illustrated in FIG. 8.

Figure 9:
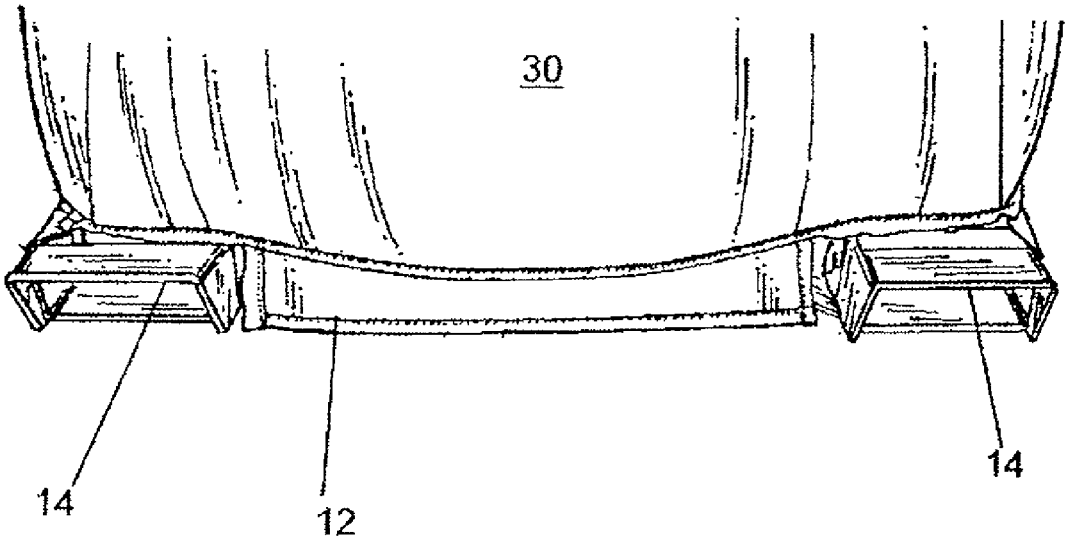
FIG. 9 illustrates a partial isolated view of the channels in the bag of the present invention.

In the improved bag of the present invention, applicant is configuring the channel sleeves and the pot belly portion, as seen in FIG. 9 of the bag as a separate unit that is simply added to the bottom of the bag. This does several things. It simplifies production issues, eliminates fabric waste and it provides additional support in the weak areas just previously mentioned. Applicant intends that this structure coupled with a channel that is engineered for the stresses as a complete package that solves the problems encountered in the past. By tying the channel sleeves to the pot belly portion of the bag, as seen in FIG. 9, the two sleeves and the pot belly are forced to work together as a united unit to overcome the various natural stresses discussed earlier. As the free flowing product attempts to push the side walls of the pot belly outward, it contacts the plastic channel and attempts to outwardly displace it. As the channel begins to move outwardly, it immediately encounters the outer sleeve which is tied to the pot belly. The outer sleeve then restricts the movement and in the process spreads these forces out along its entire length.

Figure 10:
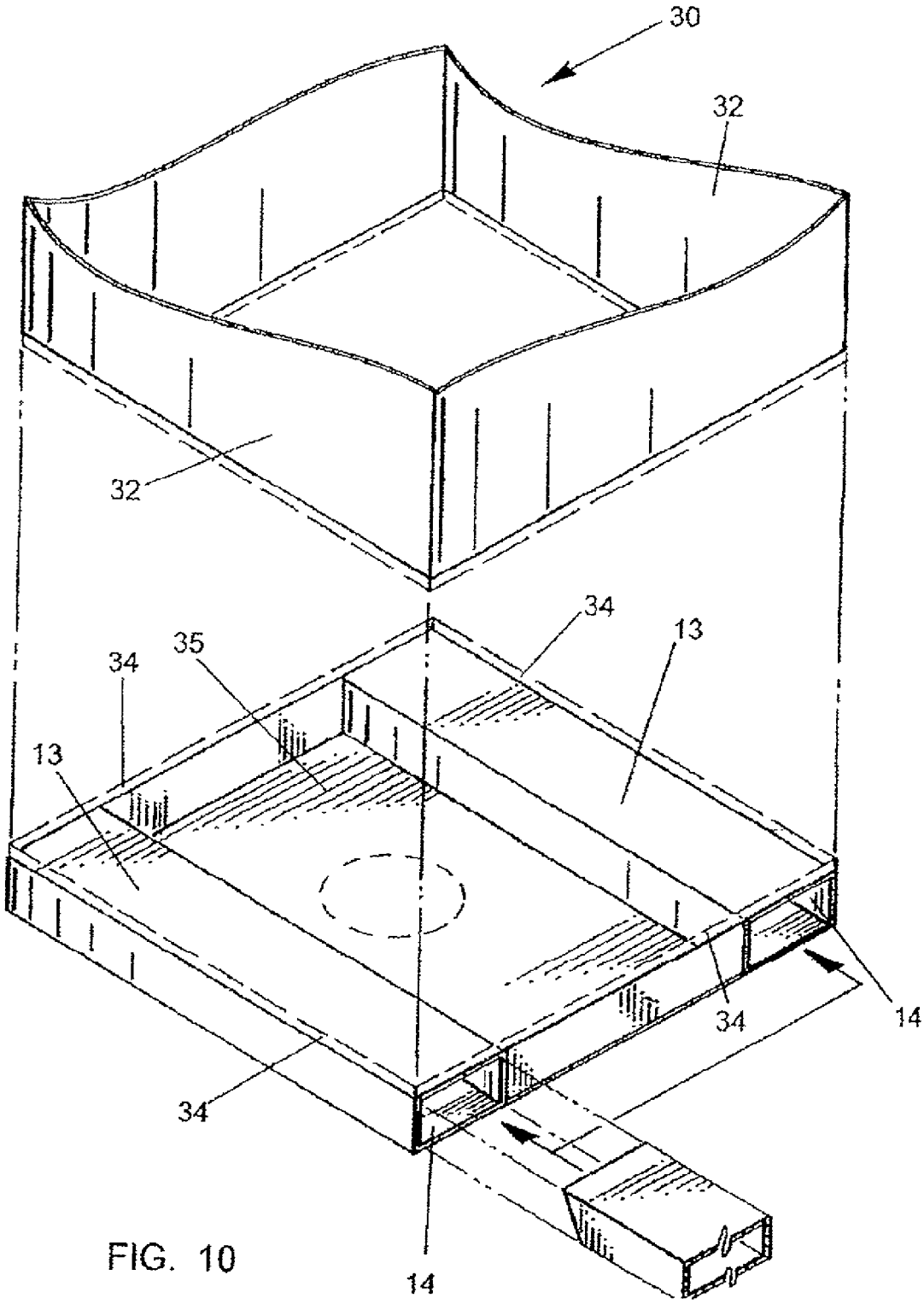
FIG. 10 illustrates yet another view of the channels of the present invention.

The bag which was witnessed by applicant, had envisioned putting two sleeves inside the bag and product area forming a space for the channels. This method is difficult to achieve and wasteful of materials. Further, it provides for the bag body fabric to be unbroken between the bag and the pot belly portion. The result of this design is a stress point at the upper inside corners of the channel. In FIG. 10, one can see how close to the corners the stress lines come and this can lead to bag failures as indicated by the two arrows pointing at these stress corners.

Figure 12:
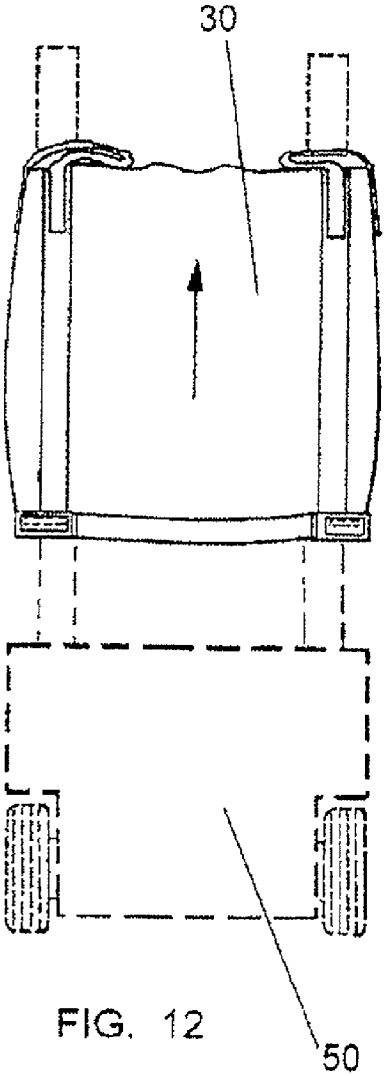
FIG. 12 illustrates an additional view as illustrated in FIG. 11.
Figure 11:
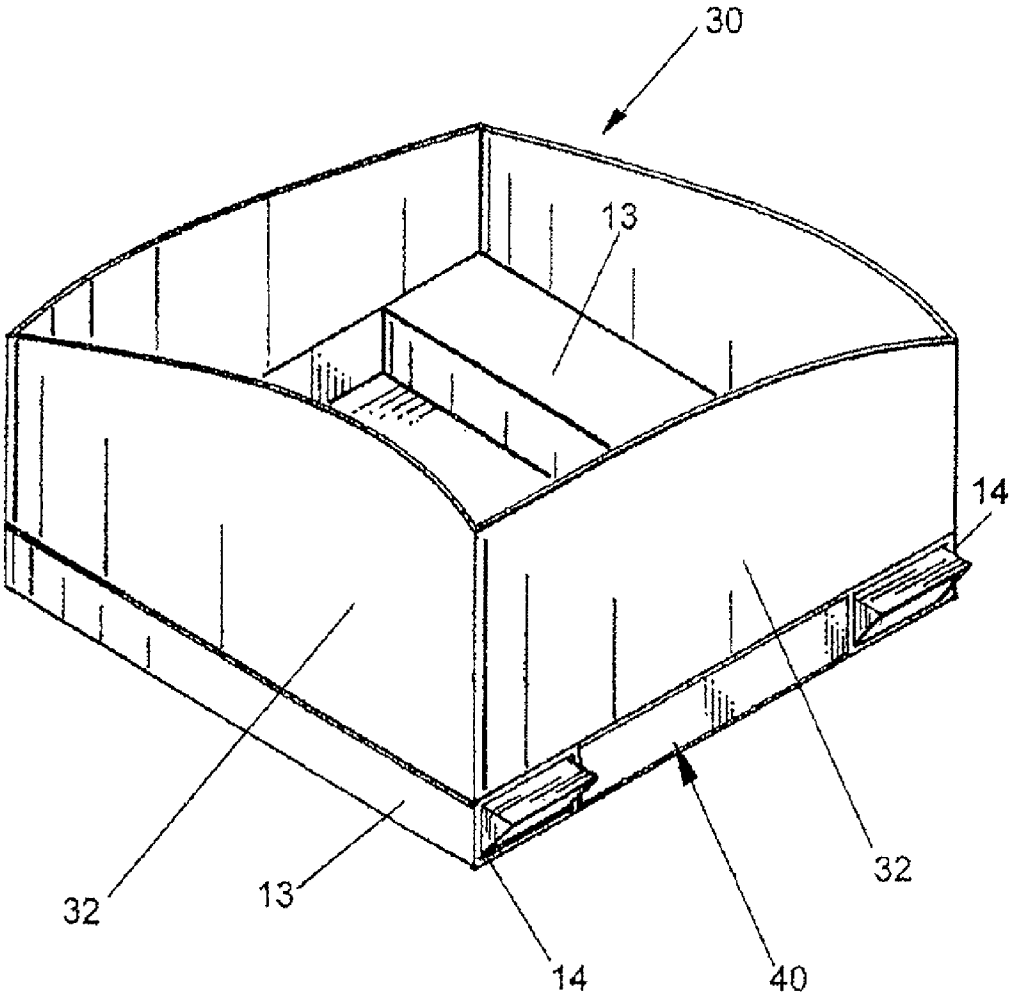
FIG. 11 illustrates an isolated view of a filled bag and the pot belly portion in the present invention.
Figure 13:
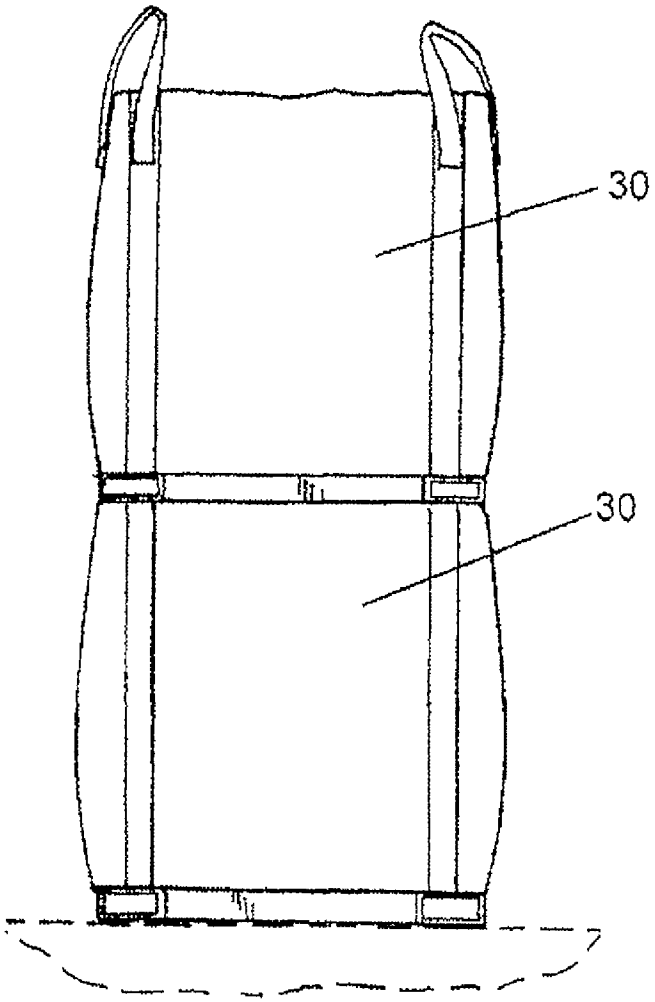
FIG. 13 illustrates a pair of filled bulk bags stacked upon one another of the present invention.

With applicant's new design, elastic will not be needed to maintain the position of the channels. Once the bag is filled, the outward force of the product applies great pressure to the channels and holds them in place for most applications. However, applicant believes that the addition of small protrusions from the channels will increase the hold between the channels and the sleeves and prevent the channels from being ejected in even very severe applications. As illustrated in FIG. 11, the new and improved pot belly bag of the present invention is suspended by a forklift. As illustrated in FIG. 12, the improved pot belly bag of the present invention is filled and is set on a flat surface such as a floor while, as illustrated in FIG. 13, the pot belly bag of the present invention indicates two of the pot belly bags filled with materials stacked showing the openings which are created by the channels which can be easily accessed by tines of a forklift. There should be noted how straight these bags stack upon one another without the use of pallets or the like and how the bag bottom and sides maintain their integrity as was discussed earlier.

Furthermore, there has been difficulty with intermittent instability of the bag when being carried by the channels. After months of work and looking back on past efforts, the cause has been found.

The entire idea of carrying a bag in a stable position above the channels in a flexible bag revolves around preventing movement of product inside the bag.

The pot belly allows product to fill in the void between the fork channels under controlled conditions rather than having the product moving into the void during the bags first lift after filling.

It is critical to stability that product movement be restricted or prevented during transportation of the bag while the bag is supported on the pallet channels.

In the past, one has had to oversize the channel pockets or sleeves to allow easy insertion of the channels. This over sizing of the pockets has reduced the outward pressure of the product between the channels by increasing the distance from the pot belly side wall and the channel. With very mobile or slippery products, this extra space translated into the pot belly drooping downward when the bag was being lifted by the fork lift channels from beneath.

Once the bag is transported, and downward slump represents product that will be pushed up from the bottom when the bag is set down on the floor.

As the product that has drooped down is pushed up by setting in on a flat floor, it momentarily destabilizes the bag and it can take a sudden lean in any direction.

This lean becomes worse each time the bag is picked up as the product moves down in to the drooping area and then is pushed back up into the bag whenever it is set down. The uncontrolled product above moves in unpredictable ways each time this happens.

Therefore, it is desirable to prevent the drooping during lift and it is desirable to have easy channel insertion.

Figure 14:
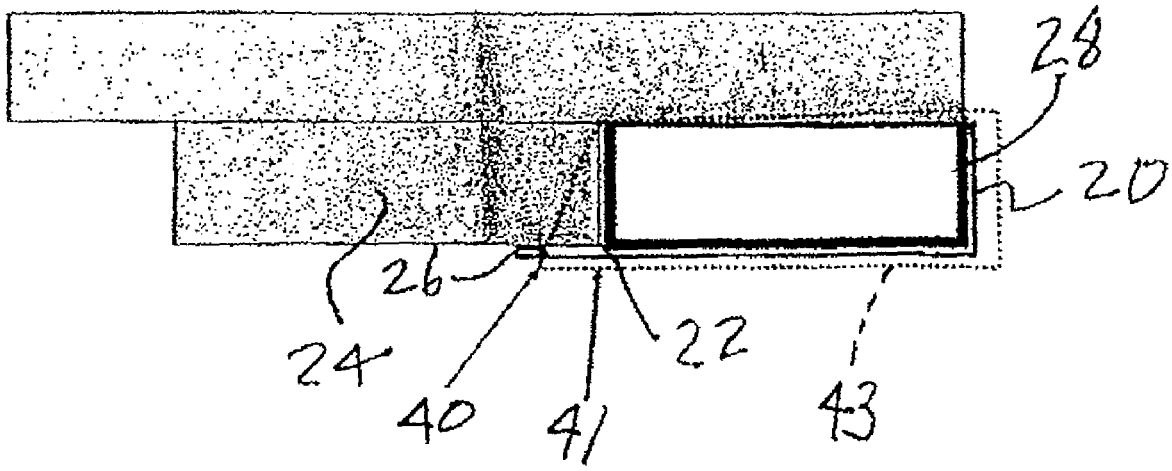
FIG. 14 illustrates the improved sleeves for receiving the channels of the present invention.

As illustrated in FIG. 14, the problem has been solved by moving the attachment of the channel sleeve 20 from the bottom corner 22 of the pot belly 24 two to three inches, to point 26, more toward the center of the pot belly 24.

By doing so, as can be seen in the attached drawing, the bottom corner 22 of the pot belly 24 can be temporarily moved away from the channel sleeve 20 for easy entry of the channel 28. This modification does allow us to size the pocket or sleeve 20 exactly to the channel 28 that will be inserted into sleeve 20, yet allow it to open for easy insertion. By sizing exactly to the channel 28, we create the tightest possible relationship between pot belly 24, channels 28 and pockets or sleeves 20. This then gives us the flattest possible bottom even when the product is very mobile.

The new point of attachment 40 is past the corner 22 of the pot belly by two to three inches. This provides a flexible area 41 the approximate size of the dotted line 43 because the lower right hand corner of the pot belly can now be pushed out of the way for easy channel insertion.

Previous point of attachment was the bottom corner of the pot belly. The size of the pocket had to be larger than the channel to allow easy insertion of the channel.

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. An improved pot belly bag which comprises:

a) a bag portion having four walls and a top portion, and a floor portion;

b) a portion extending outwardly and downwardly from the floor portion, which defines the pot belly portion; and c) a pair of channel sleeves formed along either sidewall of the pot belly portion with the channel sleeves tied to an attachment point along the bottom of the pot belly portion of the bag which results in the two sleeves and the pot belly portion functioning as a united unit to overcome various stresses normally placed upon the bag.

2. The improved pot belly bag in claim 1,wherein there is further provided a channel insertable within each of the sleeves of the bag.

3. The improved pot belly bag in claim 1, wherein the potbelly portion and the two sleeves are constructed as a separate unit added to the bottom of the bag.

4. The improved pot belly bag in claim 1, wherein the functioning of the pot belly portion and the two sleeves as a single unit restricts outward movement of the sleeves from forces of product within the bag.

5. The improved pot belly bag in claim 1, wherein the attachment point between the pot belly portion and the two sleeves is a few inches from the bottom corner of the pot belly portion toward the center of the pot belly portion.

6. The improved pot belly bag in claim 5, wherein the attachment point provides a more concise forming of the size of the two sleeve to the size of the channel so that there is provided a tight relationship between the pot belly portion, the sleeve and the channel within two sleeve.

7. The improved pot belly bag in claim 5, wherein the bag allows a free flowing product within the pot belly bag to attempt to push the sidewalls of the pot belly portion outward contacting plastic channels in an attempt to outwardly displace the channel, but as the channel begin to move outwardly the channels immediately encounter the outer sleeve which are tied to the pot belly portion which restricts outer movement and spreads the forces out along the entire length of the pot belly portion of the bag.

8. An improved pot belly bag which comprises:

a) a bag portion having four walls and a top portion, and a floor portion;

b) a portion extending outwardly and downwardly from the floor portion, which defines the pot belly portion;

c) a pair of channel sleeves formed along either sidewall of the pot belly portion with the channel sleeves tied to a point along the bottom of the pot belly portion of the bag a sufficient distance from both ends of the sleeves so that both ends of the sleeve are capable of more easily receiving a channel member that would be inserted therein; and d) the connection of the sleeves to the pot belly portion resulting in the two sleeves and the pot belly portion functioning as a united unit to overcome various stresses normally placed upon the bag.

9. The improved pot belly bag in claim 8, wherein manner in which the sleeves are engaged to the underside of the pot belly portion of the bag so that a free flowing product which may attempt to push the sidewalls of the pot belly portion outward contacts channels within the sleeves in an attempt to outwardly displace the channels, but as the channels begin to move outwardly, the outer sleeves tied to the bottom of the pot belly portion restrict outer movement and spreads the forces out along its entire length to configure a bag which rests securely on a flat surface and can support other filled bags on top.

10. The improved pot belly bag in claim 8, wherein the potbelly portion and the two sleeves are constructed as a separate unit added to the bottom of the bag.

11. The improved pot belly bag in claim 8, wherein the functioning of the pot belly portion and the two sleeves as a single unit restricts the outward movement of the sleeves from the forces of the product within the bag.

12. The improved pot belly bag in claim 8, wherein the attachment point between the two sleeves and the pot belly portion provides a more concise forming of the size of the two sleeve to the size of the channel so that there is provided a tight relationship between the pot belly portion, the two sleeve and the channel within each sleeve.

13. An improved pot belly bag, comprising a bag portion having four walls, a top portion, a floor portion;

a separate unit added to the bottom of the bag portion, the separate unit comprising a pot belly portion and two sleeves secured to both sides of the pot belly portion; and a pair of channels securable within the sleeves secured along the length of the underside of the pot belly portion of the bag so that the channels can be easily inserted into the sleeves and when a free flowing product is poured into the bag, which may attempt to push the sidewalls of the pot belly portion outward, the attachment of the sleeves to the underside of the pot belly portion restricts outer movement and spreads the forces out along its entire length to prevent sagging of the pot belly portion below the bottom of the channels, so that a flat undersurface is achieved.

14. The improved pot belly bag in claim 13, wherein the attachment point between the pot belly portion and the two sleeves is offset a distance from the bottom corner of the pot belly portion toward the center of the pot belly portion.

15. A method of constructing an improved bulk bag, comprising the following steps:

a) forming an upper bag portion defining a top portion secured to wall portions to define the upper bag portion;

b) forming a bottom portion comprising a central pot belly portion and a pair of sleeves attached along the two side walls of the pot belly portion;

c) attaching the bottom portion to the upper portion for defining a bag enclosure for receiving material therein;

d) securing channel members within each of the pair of sleeve; and e) the attachment of the pair of sleeves to the pot belly portion is a distance from the lower corners of the pot belly portion toward the center of the pot belly portion to provide a tight relationship between the pot belly portion, the pair of sleeves and the channel members within the pair of sleeves.

* * * * *